US005618377A

United States Patent [19]

Kaneko et al.

[11] Patent Number: 5,618,377

[45] Date of Patent: Apr. 8, 1997

[54] FILM SPLICER

[75] Inventors: Yutaka Kaneko, Tokyo; Junichi Satoyoshi, Kanagawa, both of Japan

[73] Assignee: Tetra Laval Holdings & Finance, S.A., Japan

[21] Appl. No.: 481,340

[22] PCT Filed: Dec. 28, 1993

[86] PCT No.: PCT/JP93/01927

§ 371 Date: Jun. 20, 1995

§ 102(e) Date: Jun. 20, 1995

[87] PCT Pub. No.: WO94/14656

PCT Pub. Date: Jul. 7, 1994

[30] Foreign Application Priority Data

Dec. 28, 1992 [JP] Japan ..... 4-349051

[51] Int. Cl.[6] ..... B65H 21/00

[52] U.S. Cl. ..... 156/504; 156/507; 156/159; 242/555.4; 242/555.6; 242/556

[58] Field of Search ..... 156/157, 159, 156/502, 504, 507; 242/555, 555.1, 555.3, 555.4, 555.5, 555.6, 556

[56] References Cited

U.S. PATENT DOCUMENTS

| | | | |
|---|---|---|---|
| Re. 29,365 | 8/1977 | Butler | 242/58.3 |
| 4,744,845 | 5/1988 | Posey | 242/556 X |
| 4,923,546 | 5/1990 | Wheeler et al. | 156/159 |
| 4,986,485 | 1/1991 | Soubrier et al. | 242/555 X |
| 5,318,646 | 6/1994 | Cardini et al. | 156/157 |
| 5,514,237 | 5/1996 | Emenaker et al. | 156/157 X |

FOREIGN PATENT DOCUMENTS

| | | | |
|---|---|---|---|
| 2207496 | 6/1974 | France . | |
| 6-191693 | 7/1994 | Japan | 242/555.1 |
| 1150322 | 10/1966 | United Kingdom . | |
| 1138356 | 6/1987 | United Kingdom . | |

*Primary Examiner*—Mark A. Osele
*Attorney, Agent, or Firm*—Lorusso & Loud

[57] ABSTRACT

A film splicer is provided in which in connecting a first film (12) and a second film (15) to each other, a residual portion cannot be formed rearwardly of a connection point of the first film (12). The film splicer includes a pair of clamping means for clamping the first and second films (12 and 15), at least one heater (67) for heating both the films (12 and 15) for heat-sealing thereof in a state in which both the films (12 and 15) have been clamped by the clamping means, and at least one cutter (71, 72) for cutting at least one of the first and second films (12 and 15) in a state in which both the films (12 and 15) have been clamped by the clamping means. The film splicer further includes a pair of arms disposed advanceably and retreatably, and the clamping means, the heater (67) and the cutter (71, 72) are mounted to each of the arms. Thus, a residual portion left rearwardly of the connection point of the first film (12) is cut away by the cutter (71, 72).

2 Claims, 10 Drawing Sheets

FILM SPLICER

TECHNICAL FIELD

The present invention relates to a film splicer.

BACKGROUND ART

In a prior art film splicer, a predetermined number of packages, after being filled with a content and transported from a filling machine, are collected in a packed pattern and wrapped with a thermally-shrinkable film, e.g., a polyethylene film.

In this case, the film is formed into a continuous configuration and wound into a roll of film Which is set on a feeder. Then, the film delivered from the feeder is continuously fed to a shrinking machine, where the film is cut into a length required for use in wrapping.

If the roll of film is emptied of film during continuous wrapping, a second roll of film (which will be referred to as a new roll hereinafter) is set on the feeder, and a second film is delivered from the new roll. However, the wrapping of the packages is continuously conducted in the shrinking machine and therefore, the prior art film splicer is of a construction such that a portion of the second film in the new roll near its leading end can be connected to a portion of the first film near its trailing end delivered from the first roll of film (which will be an old roll hereinafter) and thus, continuously supplied to the shrinking machine.

FIG. 1 is a diagram for explaining the operation of a prior art film splicer, wherein FIG. 1*a* illustrates a state before the connection, and FIG. 1*b* illustrates a state after the connection.

In FIG. 1, reference numeral 11 is an old roll; reference numeral 12 is a first film delivered from the old roll by a feeder which is not shown; reference numeral 14 is a new roll; and reference numeral 15 is a second film delivered from the new roll 14 by the feeder which is not shown. While the first film 12 is being delivered from the old roll 11, the new roll 14 is previously set on the feeder, as shown in FIG. 1*a*, and the positioning of a leading end of the second film 15 is conducted.

Reference numeral 18 is a ultrasonic sensor disposed on a transporting path for each of the films 12 and 15 for detecting a portion of each delivered film 12, 15 near a trailing end thereof; reference numerals 20 and 21 are a pair of heaters disposed in an opposed relation to each other for movement toward and away from each other. If the ultrasonic sensor 18 detects a portion of the first film near its trailing end, a control unit which is not shown allows the heaters 20 and 21 to be moved. The heaters 20 and 21 clamp and heat the portion of the first film 12 near its trailing end and the portion of the second film near its leading end to perform a heat-sealing of them at a connection point a, as shown in FIG. 1*b*. In this manner, the second film 15 can be connected with the first film 12. Reference numeral 12*a* is a residual portion formed rearwardly of the connection point a of the first film 12.

In the prior art film splicer, however, when the second film 15 is to be connected with the first film 12, the control unit starts the movement of the heaters 20 and 21 at a timing such that the portion of the first film 12 near its trailing end is passed through the ultrasonic sensor 18, thereby performing such connection.

However, the amount of first film 12 delivered varies depending upon the packed pattern of the collected packages and for this reason, it is difficult to position the portion of the first film 12 near its trailing end between the heaters 20 and 21 in conducting the heat sealing, and a residual portion 12*a* may be formed rearwardly of the connection point a, as described above.

If the second film 15 is delivered with the residual portion remaining formed, a machine used at a next step is not normally operative. Thereupon, before the residual portion enters the machine used at the next step, it is necessary to stop the machine and remove the residual portion.

Accordingly, it is an object of the present invention to provide a film splicer, wherein the problems associated with the prior art film splicer are overcome, and in connecting the first film in the old roll and the second film in the new roll with each other, a residual portion cannot be formed rearwardly of the connection point of the first film, and the machine used at the next step need not be stopped.

DISCLOSURE OF THE INVENTION

To achieve the above object, according to a first aspect and feature of the present invention, there is provided a film splicer in which two rolls of films are alternately set, and a portion of the first film near its trailing end delivered or unwound from one of the rolls of films is connected with a portion or the second film of the other roll of film near its leading end, the film splicer comprising a pair of arms disposed for advancing and retreating movement, a pair of clamping means for clamping the first and second films, at least one heater for heating both the films for heat sealing thereof in a state in which both the films have been clamped by the clamping means and at least one cutter for cutting at least one of the first and second films in a state in which both the films have been clamped by the clamping means.

With such a construction, if the portion of the first film near its trailing end is detected, the clamping means clamp the films. Then, with the films clamped by the clamping means, the heater heats both the films for heat-sealing thereof. The cutter is advanced to cut the first film clamped by the clamping means.

Therefore, a residual portion left rearwardly of a connection point of the first film is cut away and as a result, the machine used at the next step can be operated normally.

The clamping means, the heater and the cutter are mounted to each or the arms. The clamping means has a pair of pressing members fixed to the corresponding arms for clamping both the films, when the arms are advanced to each other, a common guide disposed between the arms for alternately guiding the first and second films, and a pair of retainers for urging the guide to clamp the first and second films between the retainers themselves and the guide, when the arms are advanced.

With such construction, if the portion of the first film near its trailing end is detected, the arms are advanced, and the retainer clamps the first film between the retainer itself and the guide. Then, the cutter advanceably and retreatably disposed in the arm is advanced to cut the first film clamped between the retainer and the guide. At this time, the heater heats both the films clamped by the pressing members to heat-seal them.

In addition, according to a second aspect and feature of the present invention, there is provided a film splicer in which two rolls of films are alternately set, and a portion of the first film near its trailing end delivered or unwound from one or the rolls of films is connected with a portion of the second film of the other roll of film near its leading end, the film splicer comprising a pair of clamping means for clamping the first and second films, at least one heater for heating both the films for heat sealing thereof in a state in which both the films have been clamped by the clamping means, and at least one cutter for cutting at least one of the first and second films in a state in which both the films have been clamped by the clamping means.

The clamping means has a pair of swingable arms swingably supported, a common splicing base centrally disposed between support shafts of the swingable arms, and a pair of rollers each rotatably supported in the vicinity of a tip end of corresponding one of the swingable arms for alternately transporting the first and second films, and the rollers alternately urging the splicing base with the swinging movement of the swingable arms, thereby clamping both the films between the rollers themselves and the splicing base.

The heater and the cutter are advanced and retreated toward and away from the splicing base and the heaters are disposed on opposite sides of the cutter.

With such construction, the roller guides the film in use and receives the heater and the cutter, but because the roller is rotated by the film, the position of contact between the heater and the cutter is varied at random. This makes it possible to prevent a wearing and a damage from being produced, leading to an improved durability of the roller.

In addition, according to a third aspect and feature of the present invention, there is provided a film splicer in which two rolls of films are alternately set, and a portion of the first film near its trailing end delivered or unwound from one of the rolls of films is connected with a portion of the second film of the other roll of film near its leading end, the film splicer comprising a pair of rods disposed advanceably and retreatably and mounted to form a preset angle, a pain of heater-receiving rollers each rotatably supported at corresponding one of the rods for alternately transporting the first and second films, and a pair of sealing and cutting heaters each disposed in an opposed relation to corresponding one of the heater-receiving rollers and each including a heater and a cutter, the heater-receiving rollers being adapted to clamp both the films between the heater-receiving rollers themselves and the sealing and cutting heaters, when the rods are advanced.

With such construction, the film rolls can be set at locations other than the heater-receiving rollers and the sealing and cutting heaters and therefore, it is easy to set the film rolls.

Advantageously, the sealing and cutting heater includes a cutter centrally provided at a tip end thereof, and heaters provided on opposite sides of the cutter.

BRIEF DESCRIPTION OF THE DRAWINGS

FIGS. 5(*a*) and 5(*b*) are views illustrating the film splicer according to the second embodiment of the present invention in a third state;

BEST MODE FOR CARRYING OUT THE INVENTION

The best mode for carrying out the present invention will now be described in connection with the accompanying drawings.

Figure 1A:
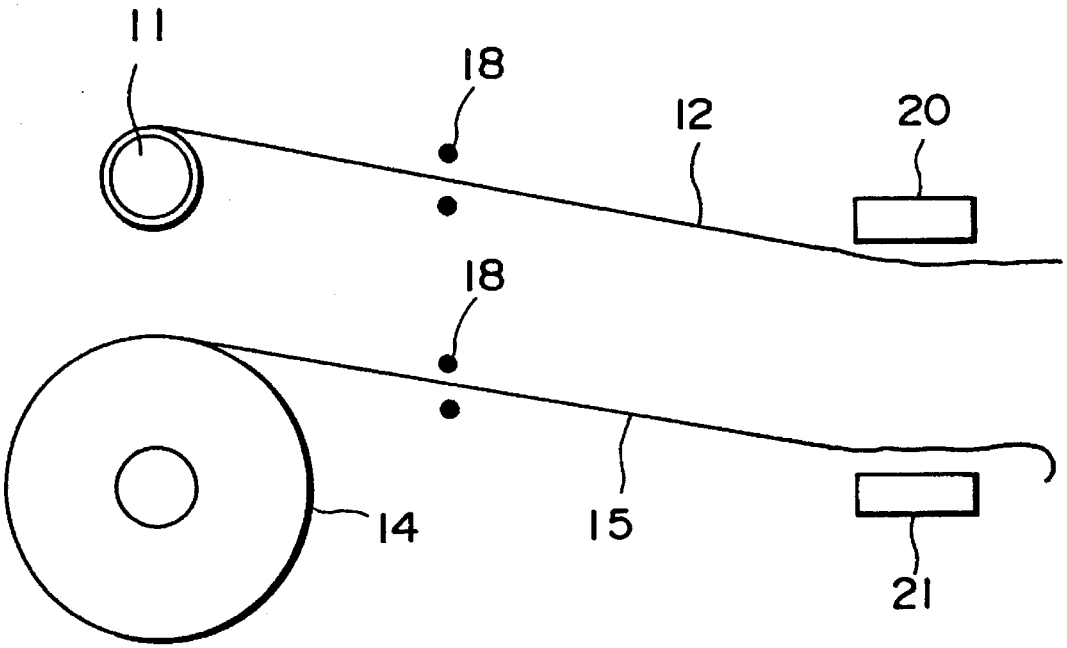
FIG. 1(a) (PRIOR ART)
FIGS. 1(*a*) and 1*b*) are diagrams explaining the operation of a prior art film splicer.
Figure 1B:
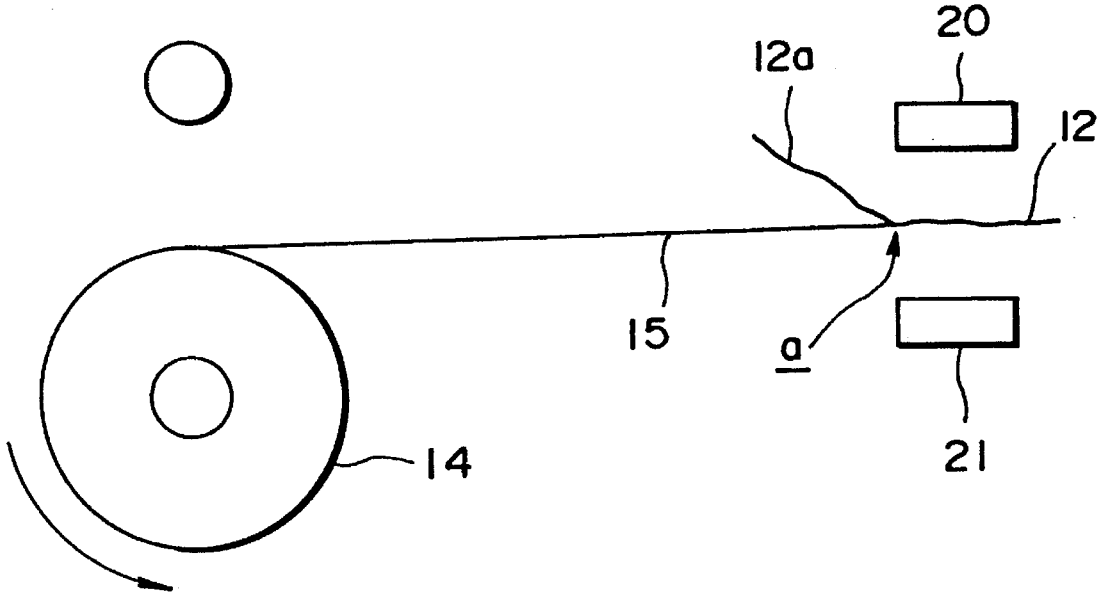
FIG. 1(b) (PRIOR ART)
Figure 2:
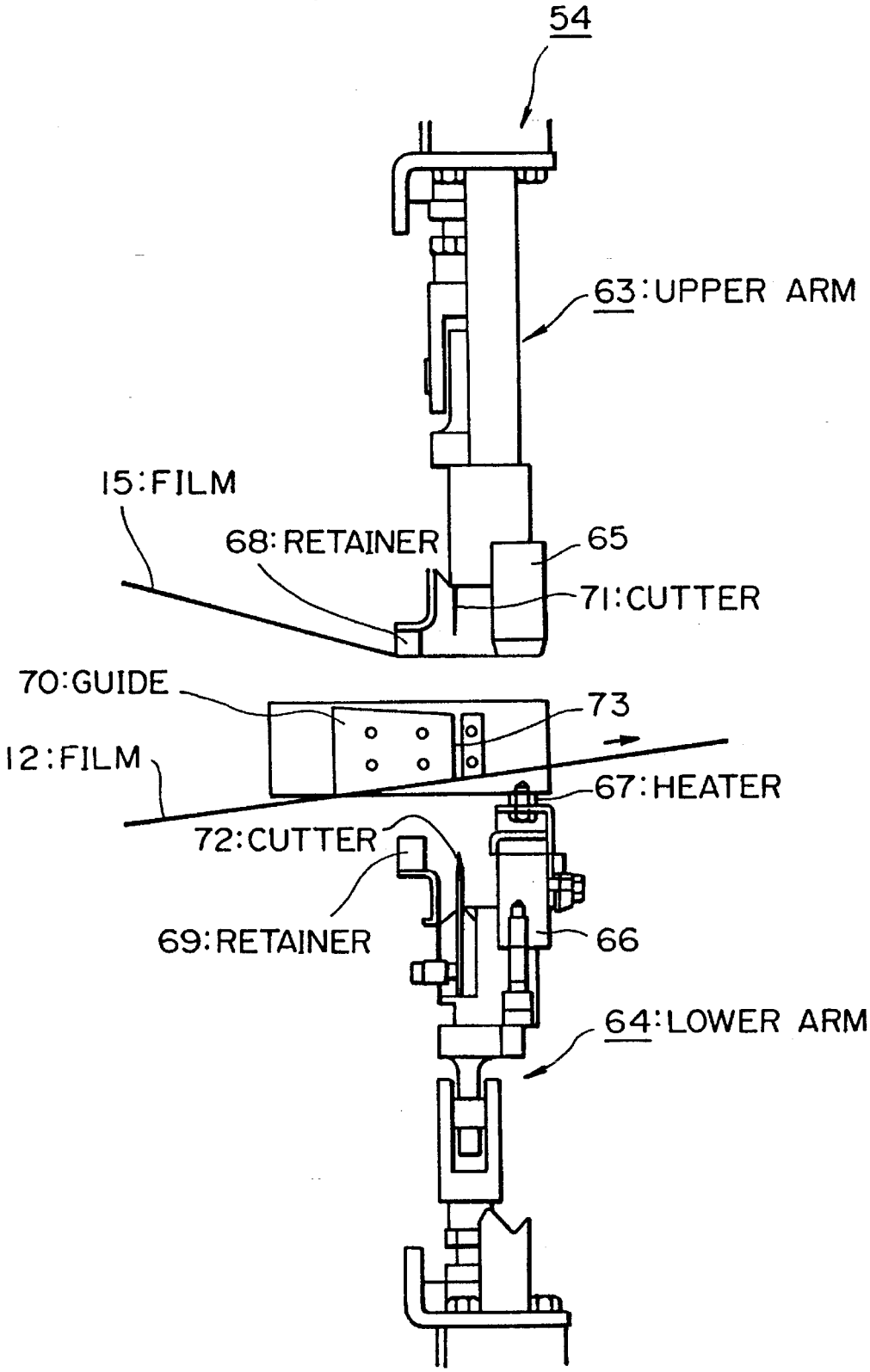
FIG. 2 is a schematic view of an essential portion of a film splicer according to a first embodiment of the present invention.
Figure 3:
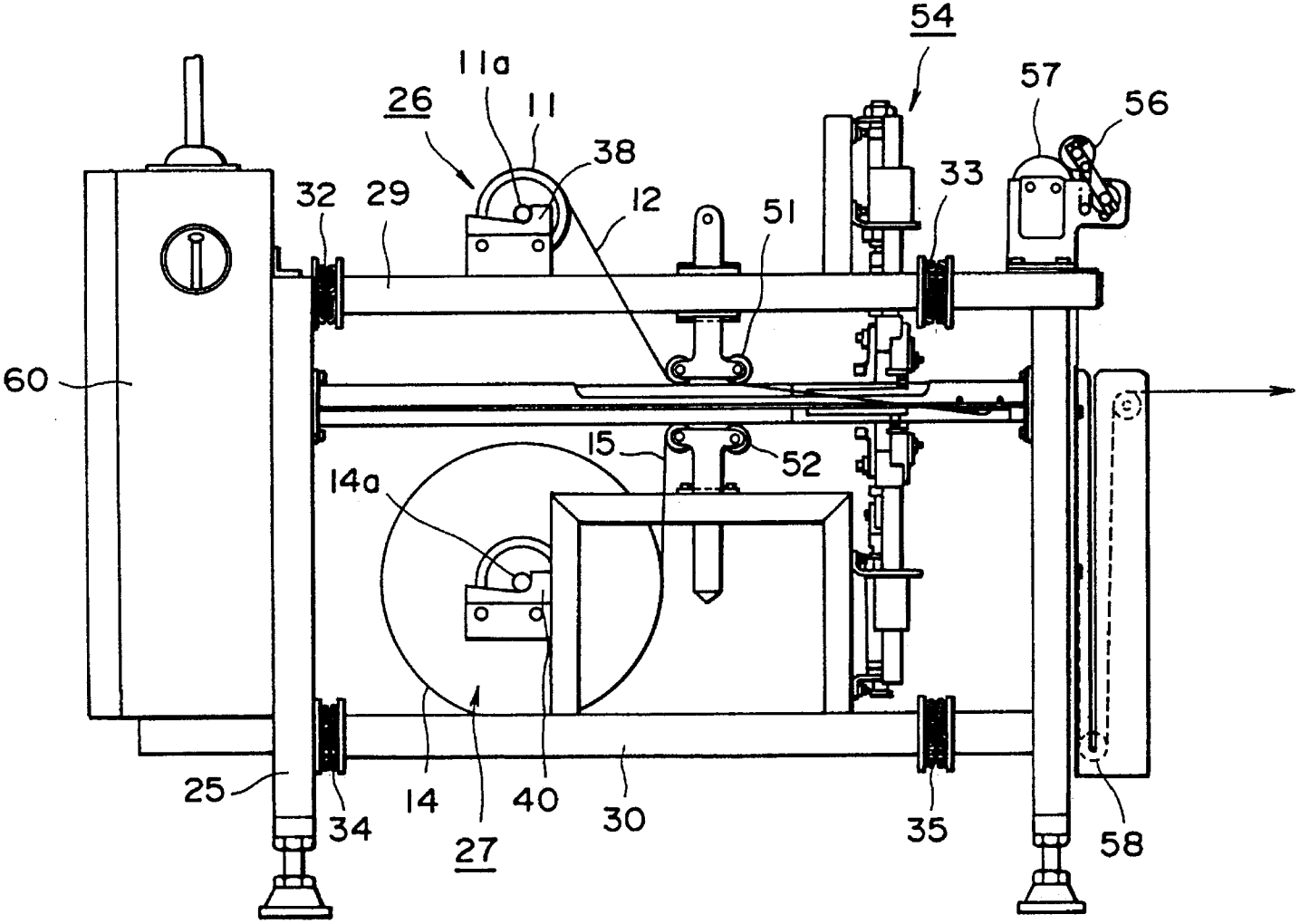
FIG. 3 is a side view of a feeder in the film splicer according to the first embodiment of the present invention.

FIG. 2 is a schematic view of an essential portion of a film splicer according to a first embodiment of the present invention; FIG. 3 is a side view of a feeder in the film splicer according to the first embodiment of the present invention; and FIG. 4 is a front view of the feeder in the film splicer according to the first embodiment of the present invention.

Figure 4:
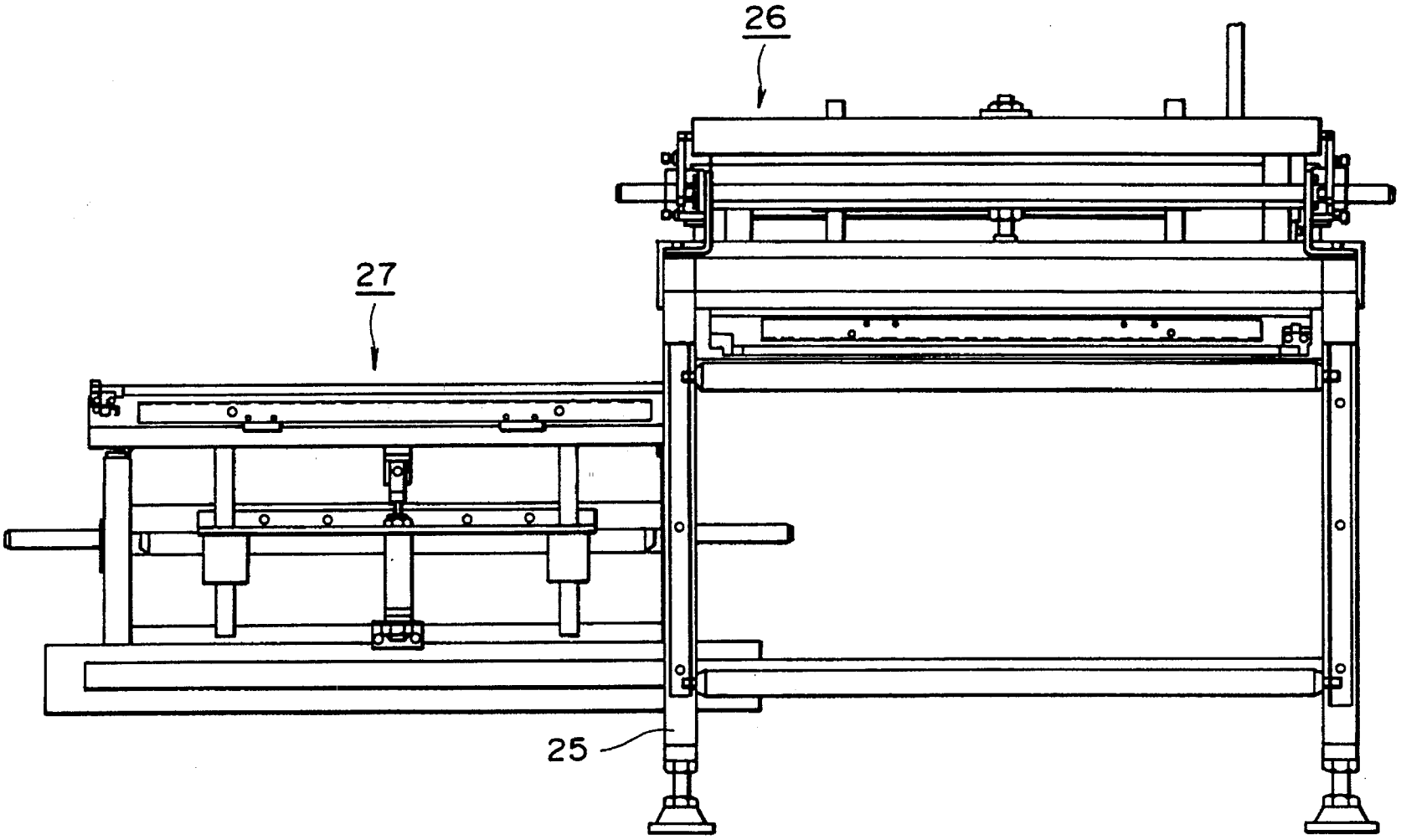
FIG. 4 is a front view of the feeder in the film splicer according to the first embodiment of the present invention.

Referring to FIGS. 2 to 4, an upper roll rest 26 and a lower roll rest 27 are disposed on a frame 25 for a feeder. Each of the upper and lower roll rests 26 and 27 has a slider 29, 30, respectively. The slider 29 is horizontally drawably supported by the frame 25 with trust bearings 32 and 33 interposed therebetween, while the slider 30 is horizontally drawably supported by the frame 25 with trust bearings and 35 interposed therebetween. FIG. 4 illustrates the horizontally drawn state of the lower roll rest 27.

L-shaped support members 38 and 40 are fixed to the sliders 29 and 30, respectively. Each of the L-shaped support members 38 and 40 comprises a horizontal portion and a vertical portion. The horizontal portion has a shape slightly inclined downwardly toward the vertical portion. Therefore, when an old roll 11 and a new roll 14 are placed on the horizontal portions respectively, each of roll pins 11*a* and 14*a* is moved by gravity to a connection between the horizontal and vertical portions, so that each of the rolls 11 and 14 can be set in a stable state.

It should be noted that for convenience, the old roll 11 is set on the upper roll rest 26,1 while the new roll 14 is set on the lower roll rest 27, but after all the first film 12 in the old roll 11 is used, the next new roll 14 may be set on the upper roll rest 26.

The first and second films 12 and 15 delivered from the old and new rolls 11 and 14 are fed through guide rollers 51 and 52 to a splicing section 54, respectively.

In the splicing section 54, a portion of the first film 12 near its trailing end and a portion of the second film 15 near its leading end are clamped and heated by a heater which is not shown, so that they are heat-sealed at a connection point which is not shown. In this manner, the first and second films 12 and 15 can be connected to each other. In this case, a residual portion left rearwardly of the connection point of the first film 12 is cut away by a cutter which will be described hereinafter.

The first film 12 with the residual portion cut away therefrom and the second film 15 which have been heat-sealed are then passed through a feed roller 57 rotated by a feed motor 56 and a dancer roller 58 to a machine used at a next step. Reference numeral 60 is a control board for controlling the splicing section 54 and the like.

The detail of the splicing section 54 will be described below with reference to FIG. 2.

As shown in FIG. 2, the roll 11 is set on the lower roll rest 27, and the new roll 14 is set on the upper roll rest 26.

The splicing section 54 is comprised of an upper arm 6B and a lower arm 64, both of which are advanced and retreated by a pneumatic cylinder which is not shown. Pressing members 65 and 66 are fixed to the upper and lower arms 63 and 64, respectively, so that the advancement of the upper and lower arms 63 and 64 to each other causes the pressing members 65 and 66 to clamp and urge the films 12 and 15.

A heater 67 is disposed in the vicinity of the pressing members 65 and 66, so that if the heater 67 is energized, the urged films 12 and 15 are heated and connected to each other by a heat-sealing.

A pair of retainers 68 and 69 are mounted to the upper and lower arms 63 and 64 upstream of the pressing members 65 and 66 in directions of transportation of the films 12 and 15, respectively, and a tapered guide 7O is mounted to a body of the splicing section 54, thereby constituting a pair of clamping means. Thus, when the upper and lower arms 63 and 64 are advanced to each other to cause the films 12 and 15 to be clamped and urged by the pressing members 65 and 66, the retainers 68 and 69 urge the upstream portions of the films 12 and 15 against the guide 70.

Further, cutters 71 and 72 are advanceably and retreatably disposed on the upper and lower arms 63 and 64 between the pressing members 65 and 66 and the retainers 68 and 69 in the directions of transportation of the films 12 and 15, respectively. Thus, the first film 12 can be cut by selectively inserting the cutters 71 and 72 into a cutter guide portion 73 formed in the guide 70. In this case, the old roll 11 has been set on the lower roll rest 27 and hence, the cutter 72 is advanced and inserted into the cutter guide 73.

It should be noted that an ultrasonic sensor which is not shown is provided for detecting a portion of the first film 12 near its trailing end.

In the splicing section 54 having the above-described construction, the new roll 14 is previously set on the upper roll rest 26. The positioning of the leading end of the second film 15 is conducted, and a portion near the leading end is laid over the pressing member 65. When the ultrasonic sensor then detects the portion of the first film 12 near its trailing end, the control board 60 actuates the splicing section 54 to advance the upper and lower arms 63 and 64, thereby causing both the films 12 and 15 to be clamped and urged by the pressing members 65 and 66, while at the same time, the upstream portions of the films 12 and 15 are urged against the guide 70 by the retainers 68 and 69, respectively.

Then, the cutter 72 is advanced and inserted into the cutter guide portion 73 to cut away the residual portion of the first film 12, and the heater 67 heats both the films 12 and 15 to heat-seal them. In this manner, the first and,second films 12 and 15 can be connected to each other.

Therefore, the residual portion of the first film 12 cannot be left, and the machine used at the next step cannot be stopped.

The upper and lower arms 63 and 64 are disposed in a vertically symmetrical arrangement and hence, even if the old roll 11 is set on any of the upper and lower roll rests 26 and 27, the first and second films 12 and 15 can be connected to each other.

A second embodiment of the present invention will be described below.

Figure 5A:
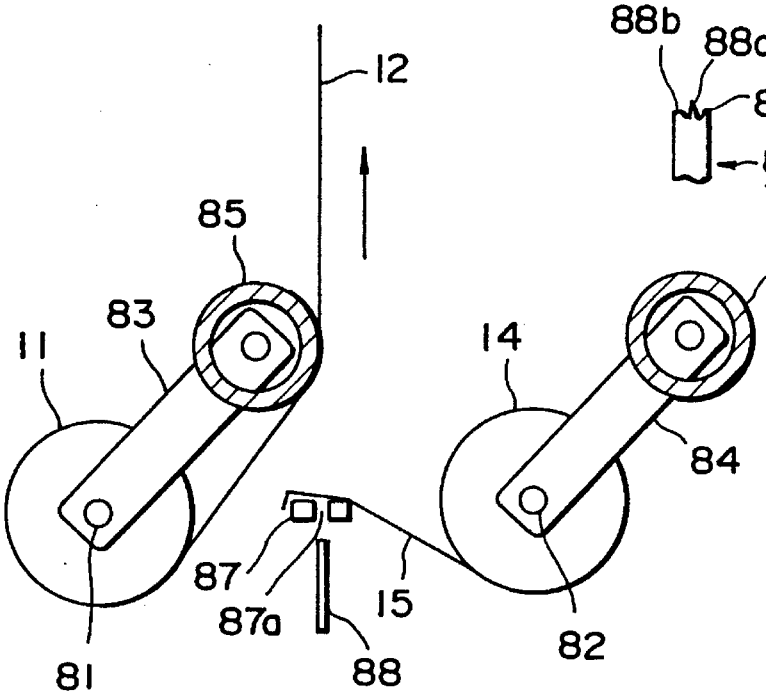
FIG. 5 is a view illustrating a film splicer according to a second embodiment of the present invention in a first state.
Figure 5B:
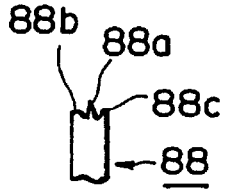
Figure 6:
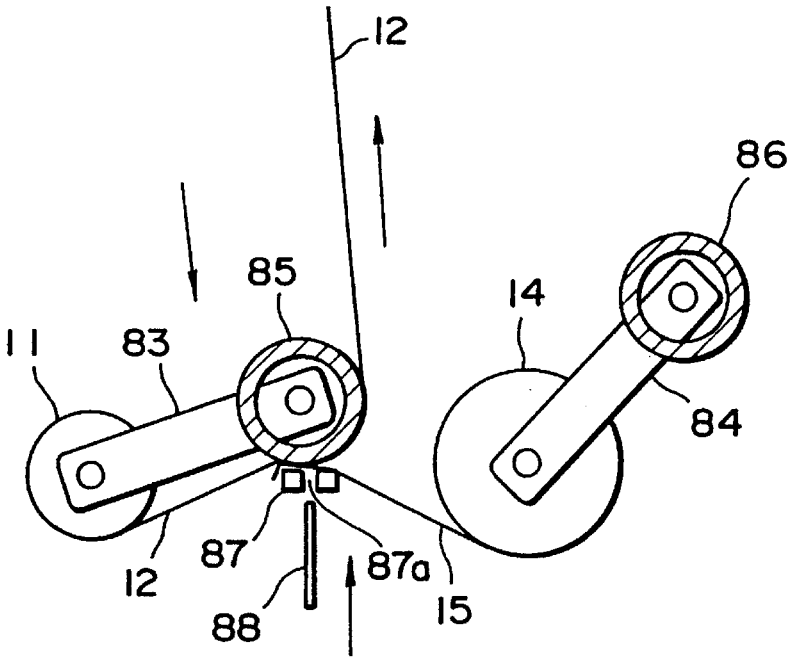
FIG. 6 is a view illustrating the film splicer according to the second embodiment of the present invention in a second state.
Figure 7:
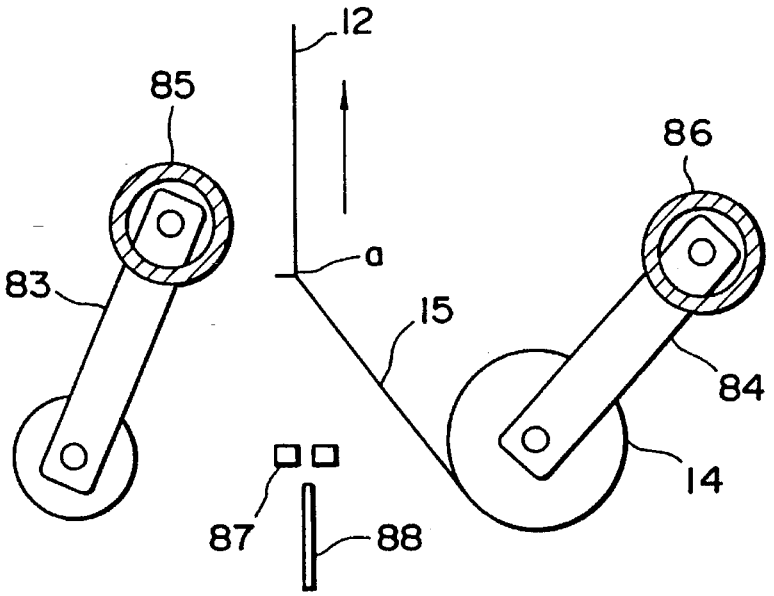
Figure 8:
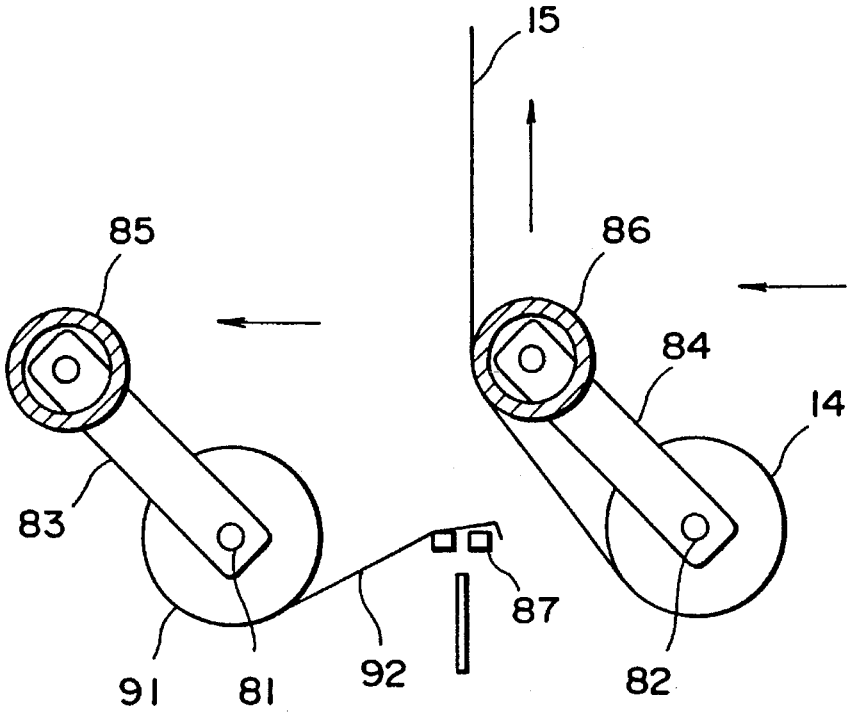
FIG. 8 is a view illustrating the film splicer according to the second embodiment of the present invention in a fourth state.

FIG. 5 illustrates a film splicer according to the second embodiment of the present invention in a first state; FIG. 6 illustrates the film splicer according to the second embodiment of the present invention in a second state; FIG. 7 illustrates the film splicer according to the second embodiment of the present invention in a third state; FIG. 8 illustrates the film splicer according to the second embodiment of the present invention in a fourth state, wherein FIG. **5*a* is a schematic illustration of an essential portion of the film splicer, and FIG. 5*b*** is a detailed illustration of a sealing and cutting heater.

In FIGS. 5 to 8, reference numeral 11 is an old roll; reference numeral 12 is a first film; reference numeral 14 is a new roll; and reference numeral 15 is a second film. Reference numeral 81 is a support shaft on which the old roll 11 is rotatably set and which serves to support a swingable arm 83 for swinging movement, and reference numeral 82 is a support shaft on which the new roll 14 is rotatably set and which serves to support a swingable arm 84 for swinging movement.

Silicone rubber rollers 85 and 86 are rotatably carried at tip ends of the swingable arms 83 and 84 to transport the first and second films 12 and 15, respectively, thereby constituting a pair of clamping means. A splicing base 87 is provided for selectively supporting the silicone rubber rollers 85 and 86. Thus, the films 12 and 15 can be clamped by swinging the swingable arms 83 and 84 and urging the silicone rubber rollers 85 and 86 against the splicing base 87.

Further, a sealing and cutting heater 88 is disposed for advancing and retreating movements toward and away from the splicing base 87, so that the films 12 and 15 are cut and heated for heat-sealing by selectively inserting the sealing/cutting heater 88 into a heater guide **87*a* centrally defined in the splicing base 87. For this purpose, a cutter 88*a* is centrally formed at a tip end of the sealing/cutting heater 88, and heaters 88*b* and 88*c* are formed at the tip end of the sealing/cutting heater 88 on opposite sides of the cutter 88*a*. For the sealing and cutting heater 88**, for example, a ribbon heater or the like need not be used, but a usual heater may be used.

Thus, the films 12 and 15 can be cut by swinging the swingable arms 83 and 84 to urge the silicone rubber rollers 85 and 86 against the splicing base 87, thereby clamping the films 12 and 15, and in this condition, advancing the cutter **88*a* to urge the films 12 and 15 against the silicone rubber rollers 85 and 86. At this time, the heaters 88*b* and 88*c* on the opposite sides of the cutter 88*a* heat the films 12 and 15** to heat-seal them.

The operation of the film splicer having the above-construction will be described below.

As shown in FIG. 5, while the first film 12 is being delivered from the old roll 11, the new roll 14 is previously set on the support shaft 82. Then, the positioning of the leading end of the second film 15 is conducted, and a portion of the second film 15 near its leading end is laid over the splicer base 87. When the ultrasonic sensor which is not shown detects a portion of the first film 12 near its leading end, or detects the film-wound diameter of the old roll 11, the control board which is not shown allows the swingable arm 83 to be swung, thereby placing the silicone rubber roller 85 onto the splicing base 87.

Subsequently, as shown in FIG. 6, the sealing/cutting heater 88 is advanced and inserted into the heater guide 87*a* to heat and cut the films 12 and 15 for heat-sealing thereof. In this case, since the heaters 88*b* and 88*c* are disposed adjacent the cutter 88*a*, the first and second films 12 and 15 are connected at a connection point a, and a residual portion of the first film 12 is cut away, as shown in FIG. 7.

Then, the swingable arms 83 and 84 are swung, and the second film 15 is delivered, as shown in FIG. 8. During this time, a next new roll 91 is set on the support shaft 81; the positioning of a leading end of a second film 92 is conducted, and a portion of the second film 92 near its leading end is laid over the splicing base Each of the silicone rubber rollers 85 and 86 serves as both of a guide for the corresponding film 12, 15 in service and a receiver for the sealing/cutting heater 88, and is rotated by the film 12, 15, so that the location of contact between the silicone rubber roller 86, 86 and the sealing/cutting heater 88 is varied at random. Therefore, it is possible to prevent a wearing and a damage from being produced in the silicone rubber rollers 85 and 86, leading to an improved durability thereof.

In addition, the need for a mechanical cutter is eliminated, leading to a simplified structure.

A third embodiment of the present invention will bow be described below.

Figure 9:
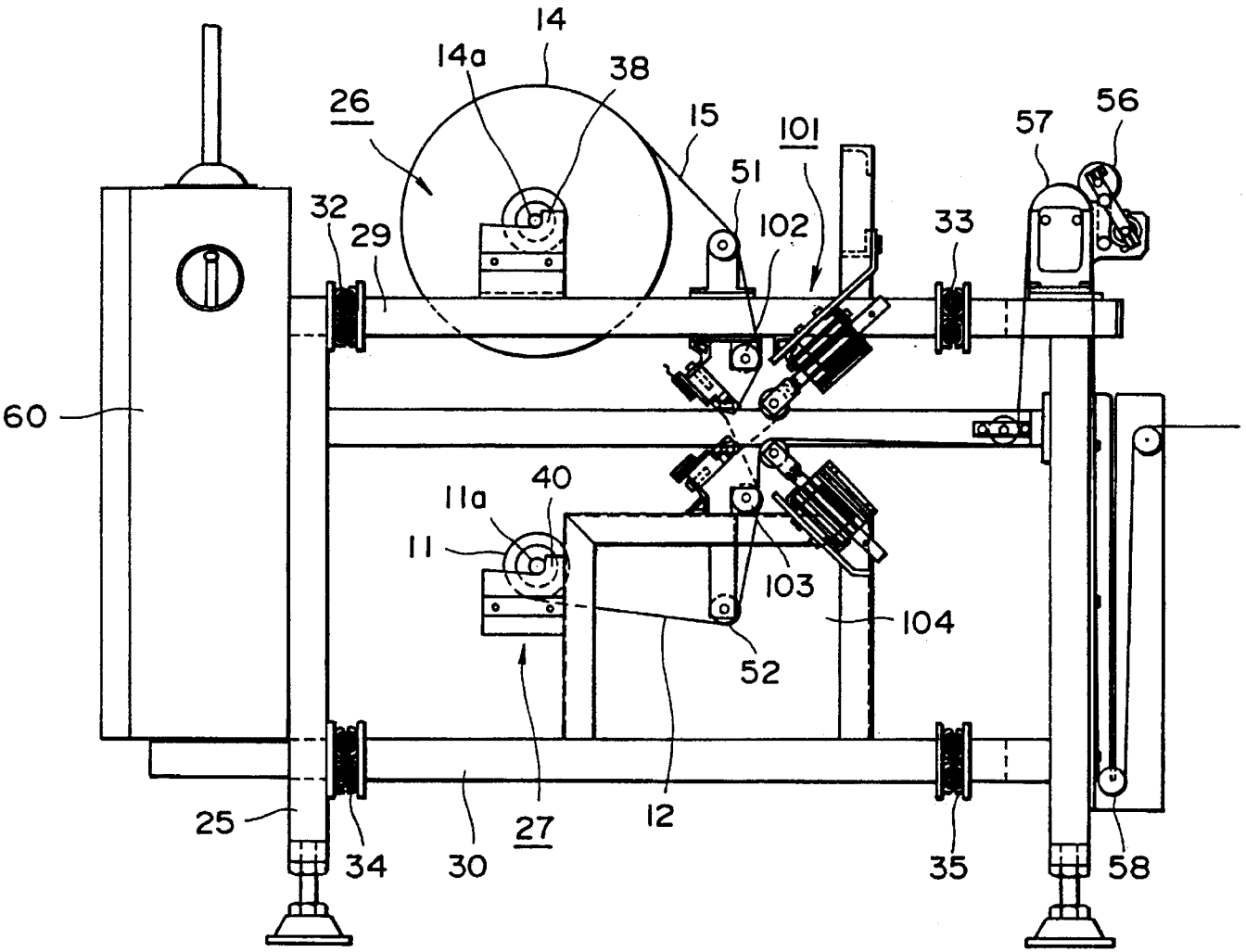
FIG. 9 is a front view of a feeder in a film splicer according to a third embodiment of the present invention.
Figure 10:
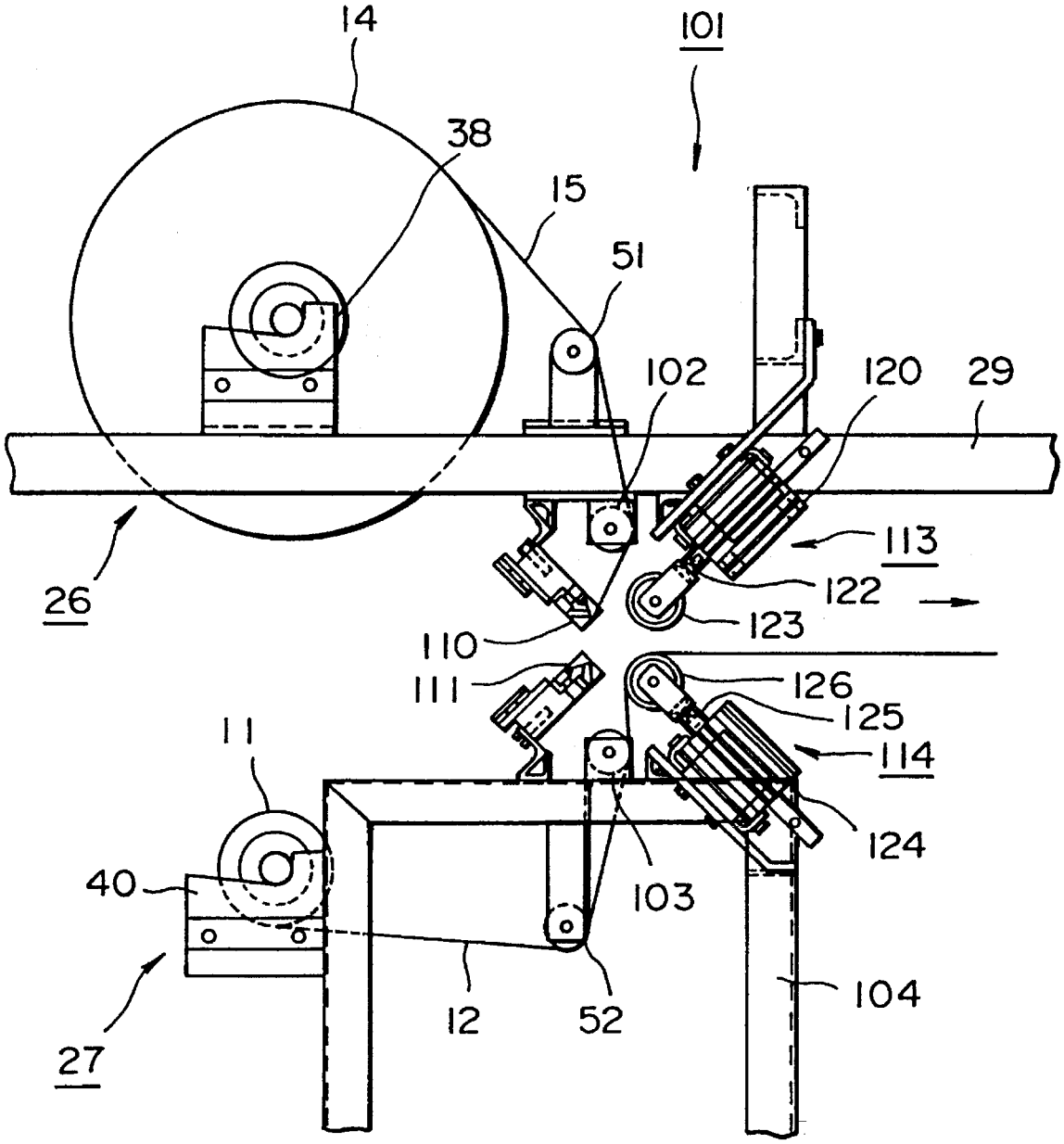
FIG. 10 is an enlarged view of an essential portion of the film splicer according to the third embodiment of the present invention.
Figure 11:
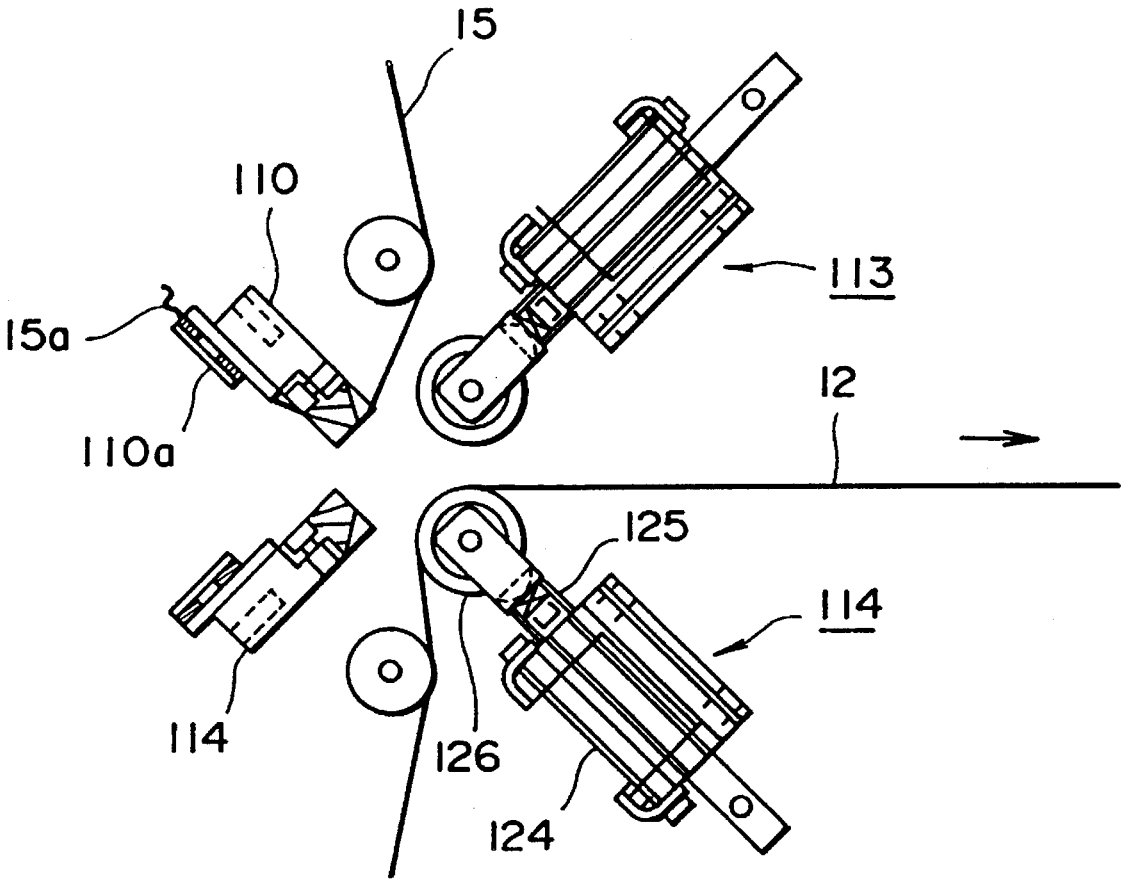
FIG. 11 is a view illustrating the film splicer according to the third embodiment of the present invention in a first state.
Figure 12:
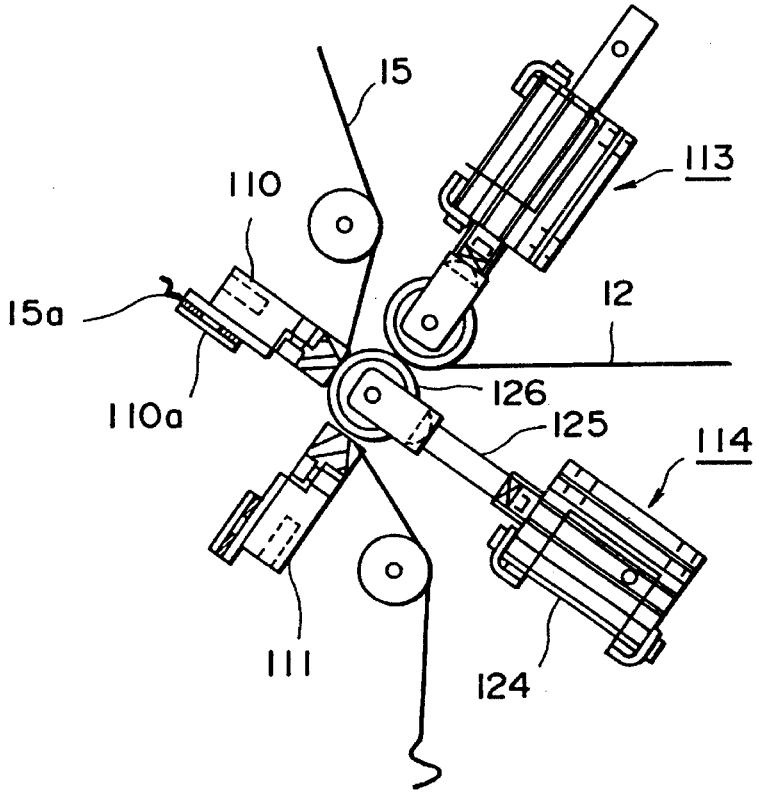
FIG. 12 is a view illustrating the film splicer according to the third embodiment of the present invention in a second state.
Figure 13:
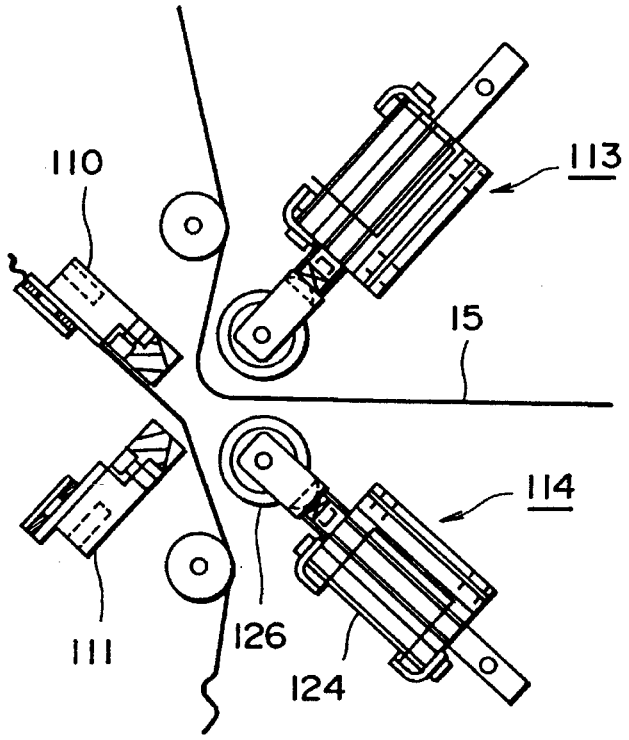
FIG. 13 is a view illustrating the film splicer according to the third embodiment of the present invention in a third state.

FIG. 9 is a front view of a feeder in a film splicer according to the third embodiment of the present invention; FIG. 10 is an enlarged view of an essential portion of the film splicer according to the third embodiment of the present invention; FIG. 11 illustrates the film splicer according to the third embodiment of the present invention in a first state; FIG. 12 illustrates the film splicer according to the third embodiment of the present invention in a second state; and FIG. 13 illustrates the film splicer according to the third embodiment of the present invention in a third state.

Referring to these Figures, an upper roll rest 26 and a lower roll rest 27 are disposed on a feeder frame 25. The first and second rolls 26 and 27 have sliders 29 and 30, respectively. The slider 29 is horizontally drawably supported by the frame 25 with slide bearings 32 and 33 interposed therebetween, while the slider 30 is horizontally 35 drawably supported by the frame 25 with slide bearings 34 and interposed therebetween.

L-shaped support members 38 and 40 are fixed to the sliders 29 and 30, respectively. Each of the L-shaped support members 38 and 40 comprises a horizontal portion and a vertical portion. The horizontal portion has a shape slightly inclined downwardly toward the vertical portion. Therefore, when an old roll 11 and a new roll 14 are placed on the horizontal portions respectively, each of roll pins 11*a* and 14*a* is moved by gravity to a connection between the horizontal and vertical portions, so that each of the rolls 11 and 14 can be set in a stable state. Moreover, it is easy to set each of the rolls 11 and 14.

It should be noted that for convenience, the new roll 14 is set on the upper roll rest 26, while the old roll 11 is set on the lower roll rest 27, but after all the first film 12 in the old roll 11 is used, a next new roll 14 may be set on the lower roll rest The first and second films 12 and 15 delivered from the old and new rolls 11 and 14 are passed through guide rollers 51, 52, 102 and 103 to a splicing section 101. The guide rollers 51 and 102 are fixed to the slider 29, while the guide rollers 52 and 103 are fixed to the slider 30 through a support base 104.

Thus, in the splicing section 101, a heater which is not shown clamp and heat a portion of the first film 12 near its trailing end and a portion of the second film 15 near its leading end to heat-seal them at a connection point which is not shown. In this manner, the first and second films 12 and 15 can be connected to each other. A residual portion of the first film in rear of the connection point is cut away by a cutter which is not shown.

The first film 12 with the residual portion cut away therefrom and the second film 15 which have been heat-sealed are then passed through a feed roller 57 rotated by a feed motor 56 and a cancer roller 58 to a machine (not shown) used at a next step. Reference numeral 60 is a control board for controlling the splicing section 101 and the like.

As shown in FIG. 10, a sealing and cutting heater 110 and a heater receiver 113 are mounted to a lower surface of the slider 29 in an obliquely downwardly directed manners while a sealing and cutting heater 111 and a heater receiver 114 are mounted to an upper surface of the support base 104 in an obliquely downwardly directed manner. The sealing and cutting heater 11O and the heater receiver 113 are opposed to each other, while the sealing and cutting heater 111 and the heater receiver 114 are opposed to each other.

Each of the heater receivers 113 and 114 includes a pneumatic cylinder 120, 124, respectively, so that a rod 122, 125 may be advanced and retreated by the pneumatic cylinder 120, 124, respectively. A pair of heater receiving rollers 123 and 126 are rotatably supported at tip ends of the rods 122, 125 for transporting the first and second films 12 and 15, respectively, thereby constituting a pair of clamping means.

Each of the sealing and cutting heaters 110 and 111 includes a cutter and heaters provided on opposite sides of the cutter, as does the sealing and cutting heater 88. Thus, the heater receiving rollers 123 and 126 are advanced toward the cutters, and the films 12 and 15 are urged against the heater receiving rollers 123 and 126, thereby cutting the films 12 and 15. At this time, the heaters provided on the opposite sides of the cutters heats the films 12 and 15 to heat-seal them.

The operation of the film splicer having the above-described construction will be described below.

As shown in FIG. 11, while the first film 12 is being delivered from the old roll 11 (FIG. 10), the new roll 14 is previously set on the upper roll rest 26; the positioning of a leading end of the second film 15 is conducted, and a portion of the second film 15 near its leading end is laid over a film magazine 110*a* of the sealing and cutting heater 110. When an ultrasonic sensor which is not shown detects a portion of the first film near its trailing end, a control board 60 (FIG. 9) actuates the pneumatic cylinder 124 to advance the heater receiving roller 126. Subsequently, when the heater receiving roller 126 is urged against the sealing and cutting heater 110, as shown in FIG. 12, the sealing and cutting heater 110 heats and cuts the films 12 and 15 to heat-seal them. In this case, since the heaters late disposed adjacent the cutter, as described above, the first and second films 12 and 15 are connected to each other at a connection point which is not shown, while at the same time, a residual portion of the first film 12 is cut away.

When the pneumatic cylinder 124 is then operated to retreat the heater receiving roller 126, as shown in FIG. 13, the second film 15 is delivered.

The embodiments of the present invention have been described in detail, it will be understood that the present invention is not limited to these embodiments, and various modifications may be made without departing from the spirit and scope of the invention defined in claims.

INDUSTRIAL APPLICABILITY

As discussed above, the film splicer according to the present invention is useful in a system for collecting a predetermined number of packages in a packed pattern and wrapping them with a film.

What is claimed is:

1. A film splicer in which two rolls of films are alternately set, and a portion of the first film near its trailing end delivered or unwound from one of the rolls of films is connected with a portion of the second film of the other roll of film near its leading end, said film splicer comprising (a) a pair of rods disposed advanceably and retreatably and mounted to form a preset angle therebetween, (b) a pair of heater-receiving rollers each rotatably supported on a corresponding one of said rods for alternately transporting the first and second films, and (c) a pair of sealing and cutting heaters each disposed in an opposed relation to corresponding one of said heater-receiving rollers and each including a heater and a cutter, (d) each said heater-receiving roller being adapted to clamp both the films between the heater-receiving roller itself and said opposed sealing and cutting heater, when said rod is advanced.

2. A film splicer according to claim 1, wherein said sealing and cutting heater includes a cutter centrally provided at a tip end thereof, and heaters provided on opposite sides of said cutter.

* * * * *

UNITED STATES PATENT AND TRADEMARK OFFICE

CERTIFICATE OF CORRECTION

PATENT NO. : 5,618,377
DATED : April 8, 1997
INVENTOR(S) : KANEKO et al

It is certified that error appears in the above-indentified patent and that said Letters Patent is hereby corrected as shown below:

Col. 1, line 17, "Which" should read --which--.

Col. 3, line 66, "Fig. 5 is a view" should read --Figs. 5(a) and 5(b) are views--.

Col. 4, line 4, delete "Figs. 5(a) and 5(b) are views" and insert --Fig. 7 is a view--.

Col. 5, line 17, "6B" should read --63--.

Col. 8, line 20, "cancer" should read --dancer--;
line 25, "manners" should read --manner,--; and
line 65, "late" should read --are--.

Signed and Sealed this
Twenty-eighth Day of April, 1998

Bruce Lehman

*Attest:*

BRUCE LEHMAN

*Attesting Officer*

*Commissioner of Patents and Trademarks*